United States Patent [19]

Cotterill

[11] Patent Number: 4,988,066

[45] Date of Patent: Jan. 29, 1991

[54] SELECTIVELY CONTROLLED KEYBOARD SUPPORT

[76] Inventor: Michael J. Cotterill, Unit 9, 141 - 151 Taren Point Road, Taren Point, New South Wales 2229, Australia

[21] Appl. No.: 452,048

[22] Filed: Dec. 18, 1989

[51] Int. Cl.[5] ..... E04G 3/00

[52] U.S. Cl. ..... 248/281.1; 108/6; 248/923

[58] Field of Search ..... 248/281.1, 274, 278, 248/918, 919, 920, 921, 922, 923, 924, 652, 664, 371; 108/6, 7, 9

[56] References Cited

U.S. PATENT DOCUMENTS

| | | | |
|---|---|---|---|
| 2,436,773 | 2/1948 | Lambert | 108/9 |
| 2,636,311 | 4/1953 | Tisdale | 108/9 |
| 4,691,888 | 9/1987 | Cotterill | 248/918 X |
| 4,706,919 | 11/1987 | Soberalski et al. | 248/281.1 |
| 4,826,123 | 5/1989 | Hannah et al. | 248/281.1 X |
| 4,834,329 | 5/1989 | Delapp | 248/923 X |

*Primary Examiner*—Ramon O. Ramirez

*Attorney, Agent, or Firm*—Pearne, Gordon, McCoy & Granger

[57] ABSTRACT

A keyboard support apparatus has a mounting bracket (11), a keyboard support bracket (15) pivotally connected via parallel bars (20, 25) permitting change in altitude of bracket (15). The mechanism may be locked against change in altitude by means of a formation 58 associated with a bar (20) which is interengageable with a formation (54) associated with bracket (15) by means of a laterally operable lever 40 resiliently biased by a spring plate 52 towards engagement. In a preferred embodiment (FIGS. 13 to 15) support bracket (15) may be tilted about a pivot (22) and the mechanism permits one handed selective operation of altitude adjustment or tilt adjustment.

18 Claims, 9 Drawing Sheets

16
20
49
30

16
42
31
15
25
42
32
20
22
42
30
27
42
25

40
14

15
49
B
B
42
41
30
33
27
A
A
22
20
25
33
30
33
37
36
34
35

SELECTIVELY CONTROLLED KEYBOARD SUPPORT

FIELD OF THE INVENTION

This invention relates to an apparatus suitable, but not exclusively, for use in supporting a processor, typewriter or an electronic keyboard.

BACKGROUND OF THE INVENTION

In offices, instruments such as electronic keyboards are commonly accessed from desks. However to minimize operator fatigue and encourage proper posture it is desirable to present the instrument to the operator at a suitably elevated position which is ergonomically efficient.

In some apparatus the keyboard support is not only able to be adjusted in altitude but is also able to be adjusted in attitude (i.e. angle of tilt).

Controls for adjustment of keyboard support elevation (and, if available, tilt) should be accessible and convenient for the operator both in respect of location and ease of operation. Desirably adjustment of altitude and/or tilt could be accomplished with on hand and without risk of damage to long fingernails. The support and adjustment mechanisms should be robust and capable of withstanding overload such as a person sitting or leaning on the support. Quick, positive, secure and convenient locking of the support at a desired height and/or at a desired angle would be advantageous.

It would further be desirable to simplify the manufacture and construction of keyboard support apparatus.

In most apparatus of this kind a threaded bolt and handle are used to clamp the parts at a particular altitude, and if tilt adjustment is provided a separate threaded bolt and handle are provided to clamp the parts at a specific angle of tilt.

U.S. Pat. No. 4,691,888 describes apparatus having a mounting bracket adapted to be secured to a desk, a keyboard support member, linkage bars pivotally mounted to the mounting bracket and to the support member whereby the support member is adapted for movement between a raised or lowered position relative to the mounting bracket and locking means for immobilizing the apparatus against such movement. In described embodiments the locking means is a clamp assembly whereby the linkage bar is clamped to the support member by a threaded bolt extending through the bar and support member and cooperating with a threaded handle.

That apparatus is convenient to use but relies upon the clamping force and friction between the parts for locking and if either is inadequate there is a risk of damage to equipment or injury to the user.

Other apparatus has been proposed in which the locking mechanism involves engagement of a pin with an aperture of the mounting bracket. The pin may be driven by a bowden cable through a link bar into an aperture of the mounting bracket. That arrangement suffers from a difficulty in engagement as well as in difficulty of control. Tolerances required to facilitate locking engagement of the pin and aperture result in an unsteady mechanism.

An object of the present invention is to provide a keyboard support apparatus which avoids at least some of the disadvantages of prior art and/or which meets the desiderata discussed above by more efficient means than prior art.

An object of preferred embodiments of the present invention is provision of a keyboard height adjustment mechanism which is simple, positive in locking, reliable and robust.

A further object of preferred embodiments is provision of a locking means for a keyboard support apparatus which allows selection between (a) a first mode in which tilt adjustment is permitted and altitude adjustment is prevented, (b) a second mode in which altitude adjustment is permitted and tilt adjustment is prevented and (c) a third mode in which both tilt and altitude adjustment are prevented.

DISCLOSURE OF THE INVENTION

According to one aspect the invention consists in a keyboard support apparatus of the kind having a mounting bracket, a support member, at least one linkage bar pivotally connected to the mounting bracket and to the support member whereby the support member and bar are adapted for movement in a vertical reference plane between a raised or lowered position relative to the mounting bracket and locking means for immobilizing the apparatus against said movement; the locking means comprising first means defining a first formation associated with the support member; second means defining a second formation associated with the bar; said formatiOns being inter-engageable to prevent movement of the bar relative to the support member, lever means acting to disengage said formations by lateral movement of the first means relative to the second means, and resilient means biasing said formations into inter-engagement.

In preferred embodiments of the invention a lever is mounted to the support bracket via a spring metal plate. The plate lies in a vertical plane but is resiliently deformable to allow lateral movement of the lever at an angle to the vertical reference plane. The plate defines a plurality of aperture formations associated with the support member. A pin formation associated with the bar when the spring plate is in a relaxed state is engagable with a selected aperture formation of the plate to lock the mechanism. The pin and aperture formations are disengageable by lateral movement of the lever.

In a highly preferred embodiment the support member is adapted for movement between a first attitude and a second attitude, the locking means being provided with third formations associated with the bar selectively inter-engageable by the lever with fourth formations to lock the support member against tilt adjustment.

BRIEF DESCRIPTION OF DRAWINGS

Embodiments of the invention will now be described by way of example only with reference to the accompanying drawing wherein.

PREFERRED EMBODIMENTS OF THE INVENTION

Figure 1:
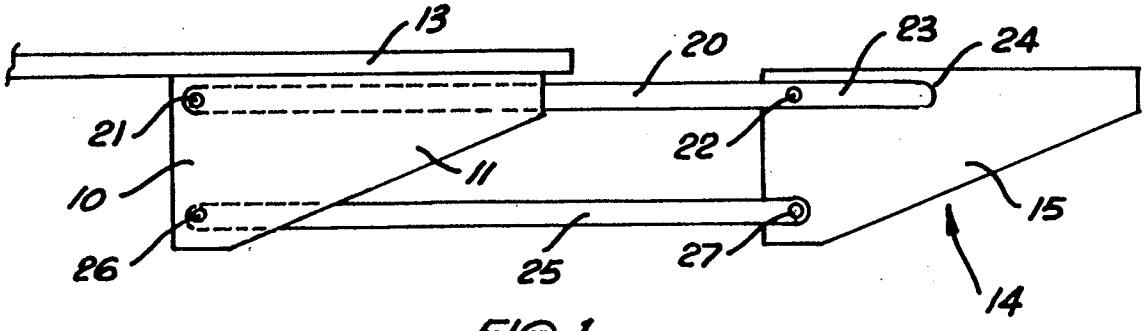
FIG. 1 shows schematically a keyboard support apparatus viewed in side elevation in a raised position.
Figure 2:
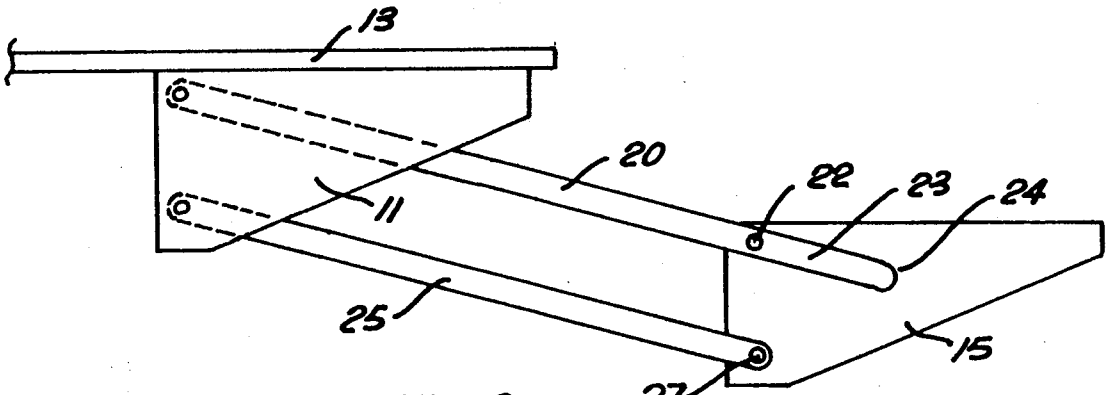
FIG. 2 shows schematically the keyboard support apparatus of FIG. 1 in a lowered position.

With reference to FIGS. 1 to 4 there is shown schematically a keyboard support apparatus of the kind under discussion.

A mounting bracket 10 comprises a vertical plate 11 and horizontal flange 12 whereby the mounting bracket may be mounted by fasteners to, for example, the underside of a desk top 13. A support member 14 comprises a vertical plate 15 and a horizontal flange 16 which in use has a keyboard or keyboard supporting platform (not shown) fastened thereto.

A first linkage bar 20 is pivotally connected by means of pivot pin 21 to bracket vertical plate 11 and is pivotally connected by means of pivot pin 22 to vertical plate 15 of support member 14. First linkage bar 20 has an extension 23 beyond pivot pin 22 to an extremity 24.

A second linkage bar 25 is pivotally connected by means of pivot pin 26 to mounting bracket plate 11 and is pivotally connected by means of pivot pin 27 to plate 15 of support member 14. The pivot pins may be rivets or other suitable fasteners and are parallel.

Bars 20 and 25 are parallel and the distance between pivot pins 21, 22 corresponds to that between pivot pins 26, 27 so that the mounting bracket, support member, first and second bars together constitute a four bar linkage or pantograph.

The arrangement permits the support member to be swung upwardly or downwardly with respect to the work surface while maintaining a constant inclination of the support member upper surface relative to the plane of the work surface.

It is convenient to define a vertical reference plane which is parallel to the plane in which bars 20 and 25 move and in which plates 11 and 15 lie.

Figure 3:
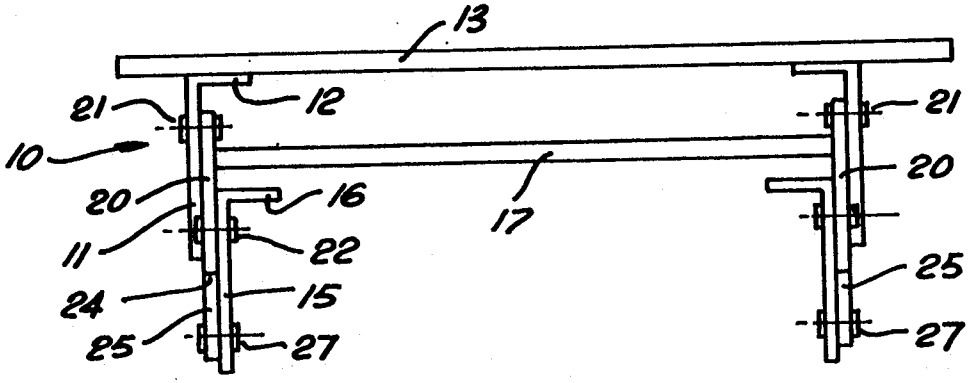
FIG. 3 shows schematically the keyboard support apparatus of FIG. 1 viewed from the front.
Figure 4:
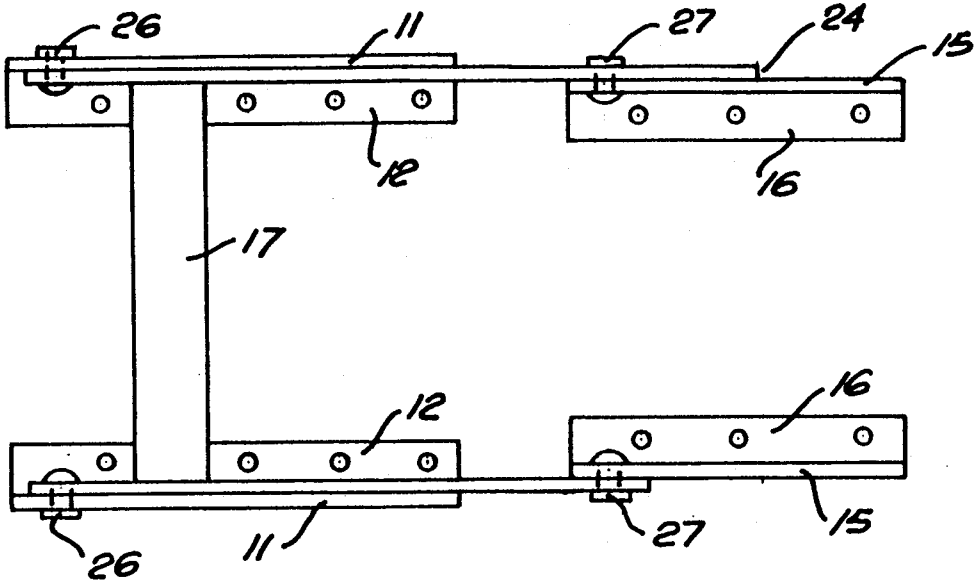
FIG. 4 the apparatus of FIG. 1 in plan viewed from beneath.

In practice as shown in FIGS. 3 and 4 the parts of the apparatus of FIG. 1 are connected by a box beam 17 to a second corresponding assembly as shown in FIGS. 3 and 4, corresponding parts being identified by corresponding numerals.

In the past, when the support member was at a required altitude, a bar 25 and the support member 14 were clamped together e.g. by a threaded bolt and cooperating threaded or handle or star wheel, for example by means of a bolt acting as pivot pin 27.

In practice also, there is commonly provided a spring (not illustrated) for assisting raising of the support member relative to the mounting bracket.

According to a first preferred embodiment of the present invention there is provided instead, or in addition, a plate 30 (FIGS. 5 to 8) made of spring steel and mounted to vertical plate 15 of mounting member 14 by means of pivot pin rivets 22, 27.

Figures 5, 6, 7, 8:
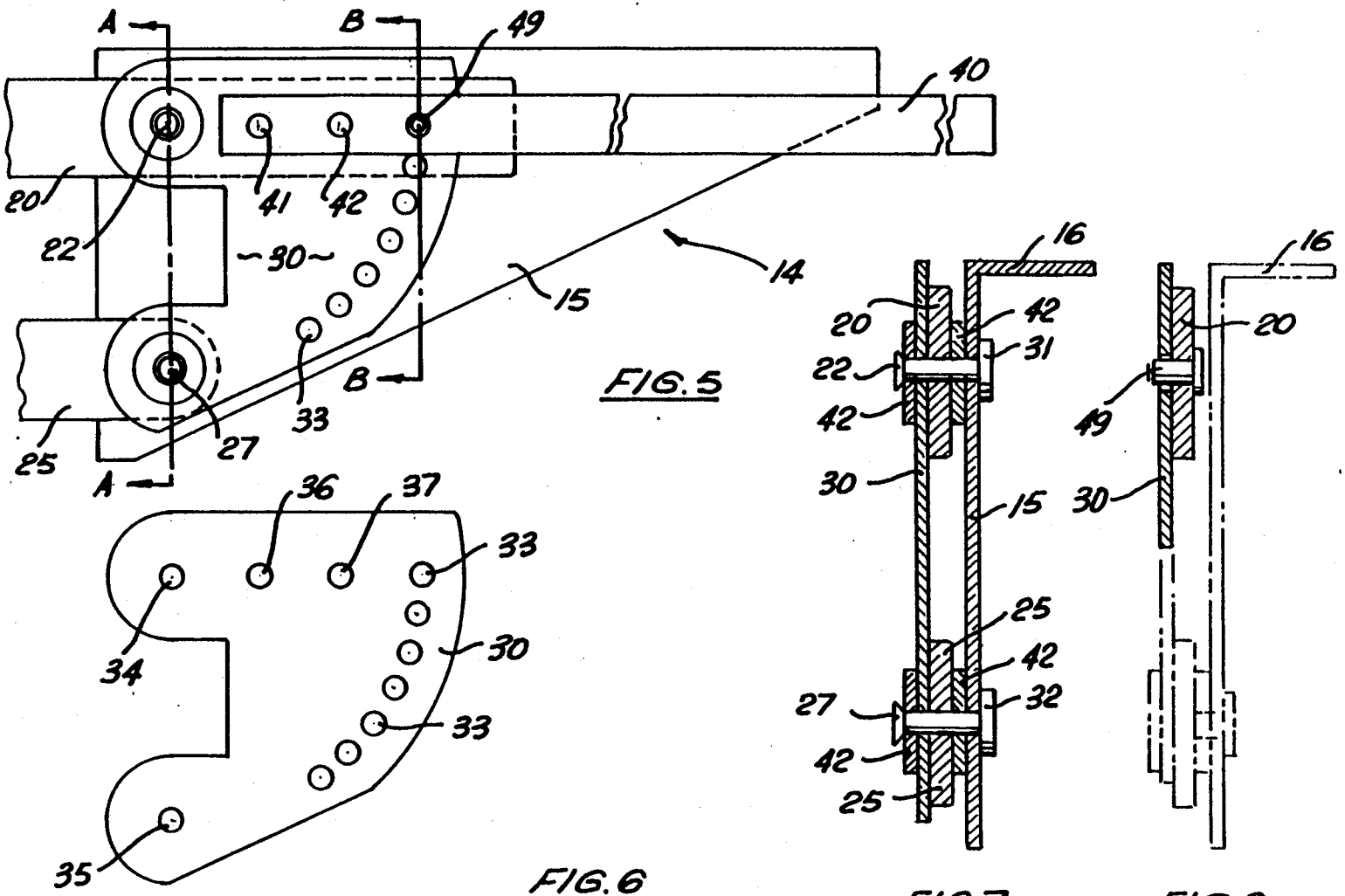
FIG. 5 shows in side view a portion of the apparatus of FIGS. 1 and 2 equipped with locking means in accordance the invention.
FIG. 6 shows plate 30 of FIG. 5 in detail.
FIG. 7 shows a section on line A—A of FIG. 5.
FIG. 8 shows a section on line B—B of FIG. 5.

Rivet heads 31, 32 of pivot pins 22, 27 are most clearly seen in FIG. 7. Plate 30 is mounted on the side of bar 20 opposite to mounting member 14 so that the extension 23 of bar 20 is sandwiched with clearance between plate 30 and plate 15.

Plate 30 is shown in FIG. 6 and has mounting apertures 34 and 35 and has a plurality of pin engaging apertures or slots 33 which are disposed on an arc, at a predetermined radius from aperture 34. Plate 30 is located by means of apertures 34, 35 on pivot pins 22, 27 respectively. Plate 30 has apertures 36 and 37 whereby the plate may be riveted to handle 40.

The outermost side of plate 30 is provided with a lever handle 40 secured to plate 30 by rivets 41, 42 extending through handle 40 and apertures 36, 37.

Plate 30 is otherwise free.

Because plate 30 is of spring steel, handle 40 acts as a lever having a fulcrum at pin 22 but adapted for lateral movement at its free end sideways towards or away from the plane of plate 15 of support member 14.

Plate 30 is resiliently biased towards a plane parallel to plate 15 but is able to be deformed on line A—A to an angle therefrom. Desirably plate 30 may, in its relaxed state, have a bend at an angle of from 2° to 4° from the plane whereby the plate is given a bias to urge plate 30 towards member 20. Extension 23 is provided with a pin 49 which extends laterally (parallel to the axis of pivot pin 25) towards plate 30 and is engagable with a selected one of apertures 33 of plate 30.

Pivot pins 25, 27 may be provided with washers 42 as desired.

In use if it is desired to move the support means from a first altitude to a second altitude, lever handle 40 is moved laterally to the side whereby plate 30 is resiliently bent or deformed at the fulcrum line A—A extending through pivot pins 22, 27 plate 30 moving away from bar 20 and support member plate 15. As plate 30 moves at an angle from bar 20, pin 49 is disengaged from apertures 33. The support member may then be raised or lowered as desired. Lever handle 40 may then be released to move plate 30 towards plate 15, allowing pin 49 to engage a selected other hole 33, pin 49 being held in engagement with hole 33 by spring plate 30 which resiliently returns to a position parallel to, and adjacent bar 20.

It will be understood that inter-engageable formations other than a pin and aperture may be employed. Also if desired two or more pins may engage two or more holes.

A second embodiment of the invention will now be described with reference to FIGS. 9 and 10 wherein parts corresponding to those of FIGS. 1 to 8 are identified by corresponding numerals. In this embodiment pivot pin 22 extends through a slot in bar 20 and a spring 19 acts between bar 20 and pin 22.

Figure 10:
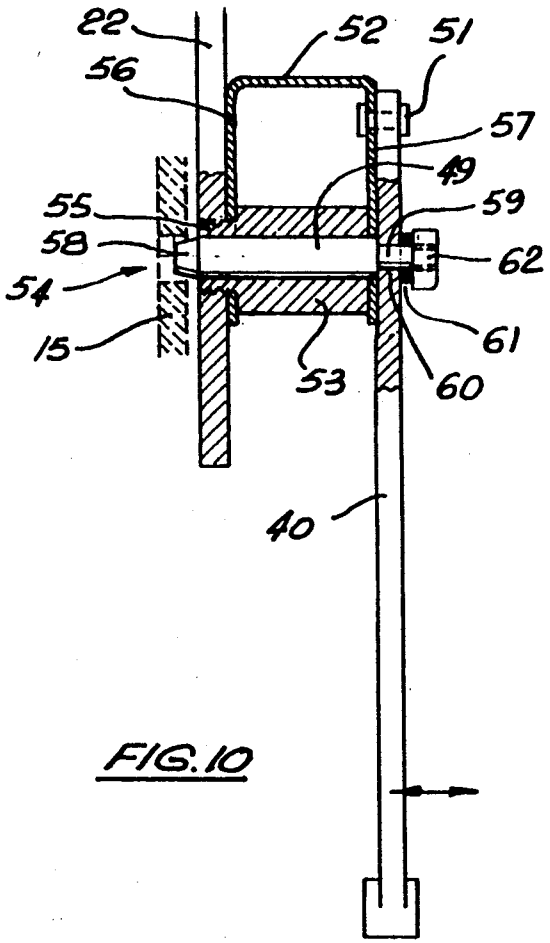
FIG. 10 shows in more detail a part of FIG. 9.
Figure 9:
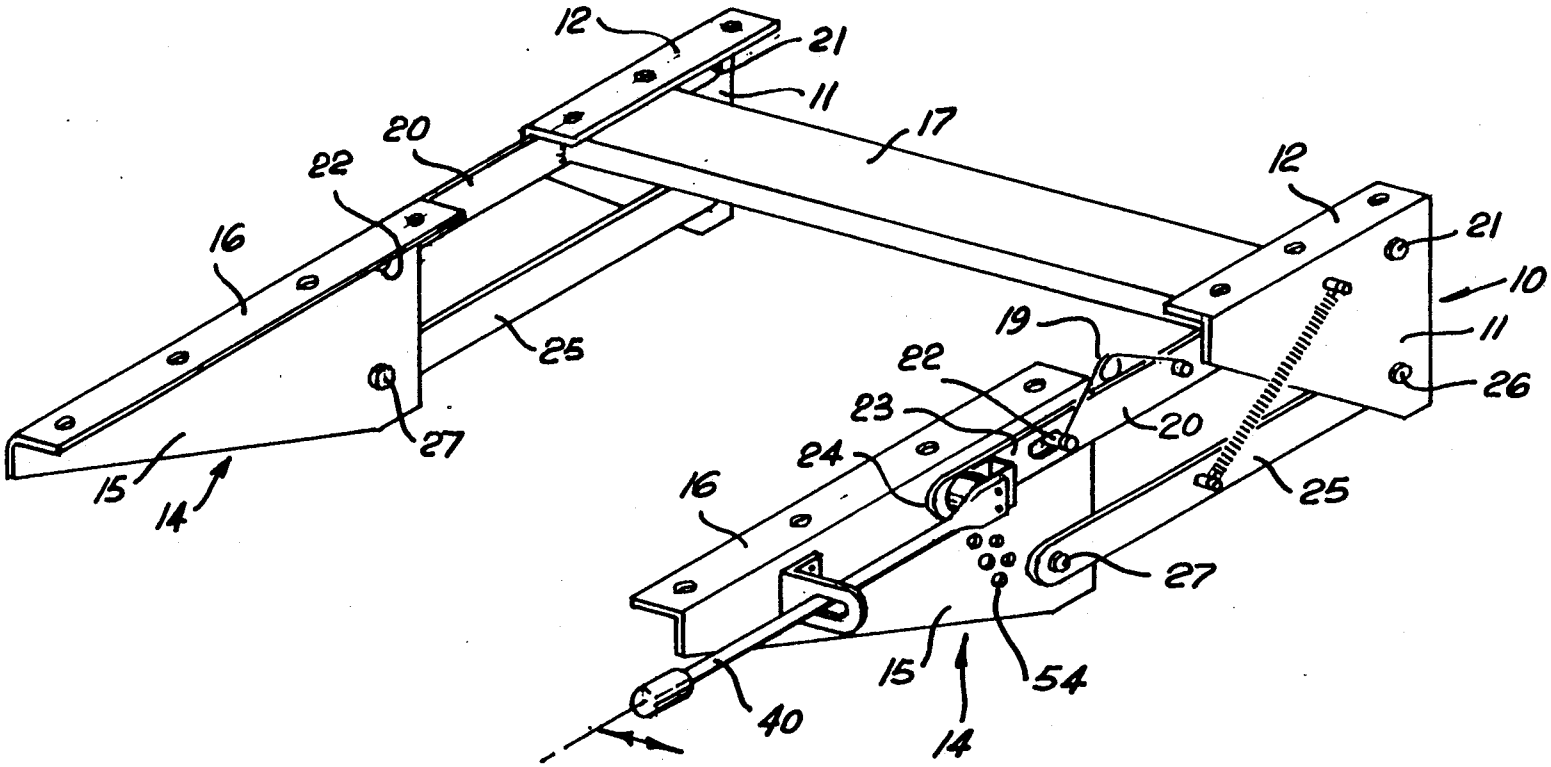
FIG. 9 shows in schematic perspective a second embodiment of the invention.

With reference to FIGS. 9 and 10 a collar 53 is stepped to a reduced diameter boss 55 adjacent bar 22 and is thread mounted to the bar. A lever handle 40 is riveted at 51 to a "U" shaped spring steel bracket 52 which is pivotally mounted to bar 22 by means of boss 55 which extends through an aperture of one arm 56 of bracket 52 and retains the arm between collar 53 and bar 22.

A pin 49 extends axially through collar 53 and boss 55. One pin end 58 is tapered and projects through bar 22 to engage in an aperture 54 or slot of plate 15. Pin 49 is reduced in diameter adjacent its other end, the portion of reduced diameter 59 extending successively through an aperture in the other arm 57 of bracket 52 through a slot 60 of lever handle 40, through an "O" ring 61, and terminating at a threaded retaining nut 62.

Lever 40 is thus mounted for pivotal movement about the axis of pin 49 and is moveable laterally by resilient deformation of bracket 52 to withdraw pin 49 from engagement with an aperture of plate 15.

The support member is adjusted to a require altitude relative to the mounting bracket and pin 49 then is engaged with a selected corresponding hole 54, the pin being biased in engagement by pin 51. In another form of this embodiment (not illustrated) bracket 52 is rigid and a compression spring acts axially on pin 41 to urge it into engagement with a selected hole 54.

In preferred embodiments of the invention at least one of bars 20, 25 is, or is associated with, a hollow duct (not illustrated) the duct being adapted to conduct a keyboard cable from a keyboard supported upon support member 14.

The duct may for example be a square section hollow tube welded to bar 20, or bar 20 may itself be of hollow section. The duct should be of sufficiently large internal dimension to enable the plug or socket terminating a keyboard cable to be threaded through the duct. The duct should convey the cable to a location near the leading edge of the rear brackets from where the cable may be connected to a computer, VDU, etc., as required.

The duct serves to keep the cabling tidy and prevents it from becoming jammed in the mechanism or inadvertently unplugged.

Figure 11:
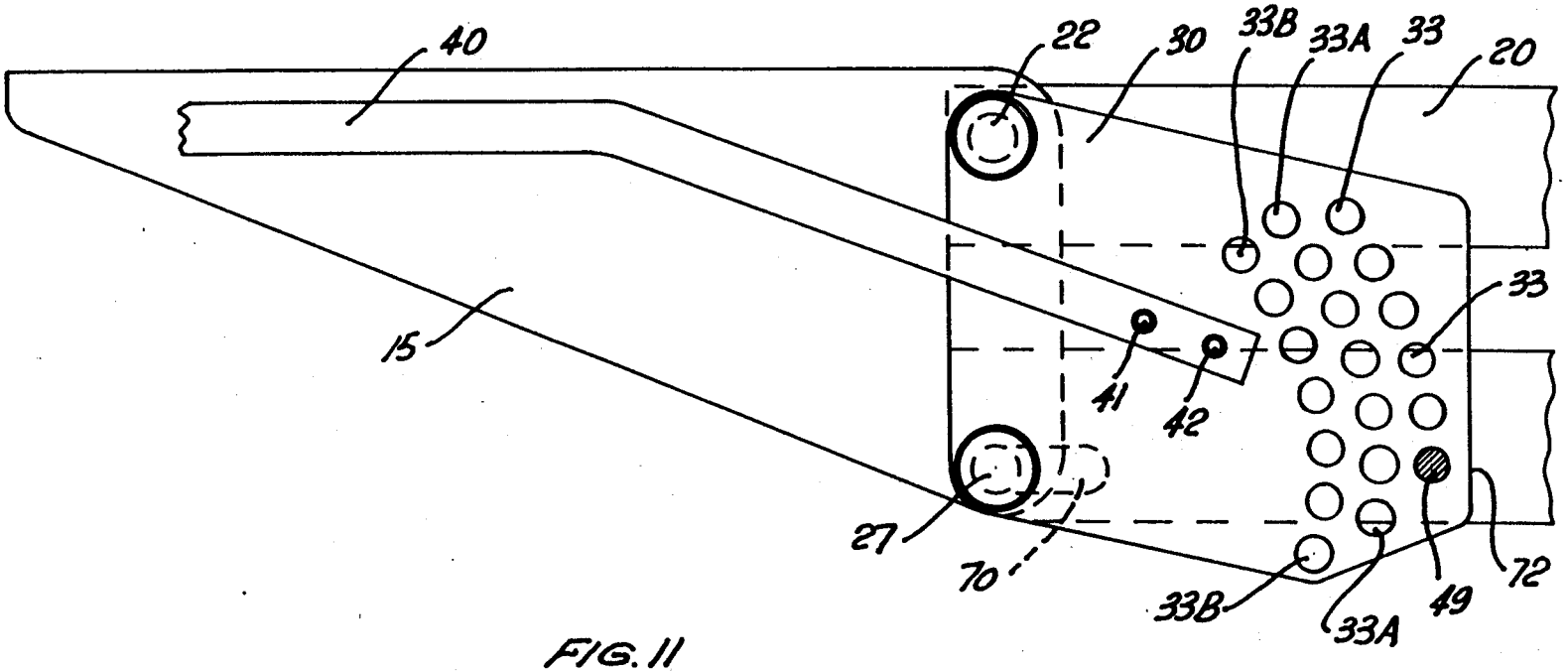
FIG. 11 shows schematically a third embodiment of the invention viewed in elevation wherein the support bracket is adapted for change in attitude (tilt)

A further embodiment of the invention will now be described with reference to FIGS. 11 and 12 wherein parts corresponding in function to those described with reference to the embodiment of FIGS. 6 to 8 are identified with like numerals. In FIG. 11 there is shown an embodiment wherein the lower bar 25 of the four bar linkage is provided at or adjacent bar end 71 with an elongate slot 70 extending in the bar longitudinal direction. Bar 25 is connected with support bracket 15 by means of pivot pin 27 extending through the slot 70. Pin 27 cooperates with slot 70 and bracket 15 to allow bracket 15 to tilt pivotally about the axis of pin 22.

Spring steel plate 30 is pivotally mounted to bars 20, 25 by means of pins 22 and 27. Spring plate 30, when released lies in a plane parallel to the vertical reference plane. Lever 40 is mounted to plate 30 e.g. by rivets 41 and 42.

Plate 30 is provided with a plurality of circular first apertures 33 disposed with centers on a first arc, a plurality of second apertures 33*a* disposed with centers on a second arc and a plurality of apertures 33*b* disposed on a third arc concentric with the first and second arc. Pin formation 49 mounted on bar 25 extends laterally and is inter-engageable with a selected aperture 33, 33A, 33B of spring plate 30. Desirably, pin 49 is chamfered at a distal end to facilitate precise insertion in an aperture 30, 30A, 30B of spring plate 30. As shown in FIG. 12, if lever 40 is moved from neutral position N (in which spring plate 30 is released) in the direction indicated by arrow B, spring plate 30 is bent on line A—A, the free end 72 of plate 30 is moved in the direction indicated by arrow C, disengaging pin 49 from aPerture 33. In this mode, lever handle 40 may be moved upwards or downwards thereby to raise or lower support bracket 15. Lever 40 is resiliently urged by spring plate 30 towards neutral position N and, when lever 40 is released, spring plate 30 returns to a plane parallel to the reference plane. Pin 49 may then be re-engaged with a conveniently-located aperture 33. If the altitude is altered without tilt adjustment, pin 49 will relocate in an aperture of the same arc as that from which it was disengaged. If it is desired to adjust tilt, lever 40 is moved laterally from neutral position N in direction B to disengage pin 49 from aperture 33 of plate 30 as described above. Lever 40 may then be moved arcuately so as to adjust attitude (i.e. tilt) of keyboard support 15 by pivotal movement about pin 22. Lever 40 is then resiliently urged towards the neutral position by spring plate 30 to re-engage pin 49 with an aperture of plate 30. In the case of tilt adjustment, pin 49 will engage an aperture in an arc different from that in which it was previously engaged e.g. will disengage from an aperture 33 and re-engage an aperture 33A or 33B. If desired, both altitude and attitude may be adjusted concurrently using one hand to move lever 40 both to engage or disengage pin 49 from an aperture of plate 30; to raise, lower or tilt the keyboard support, and to relock the mechanism against movement.

Figure 12:
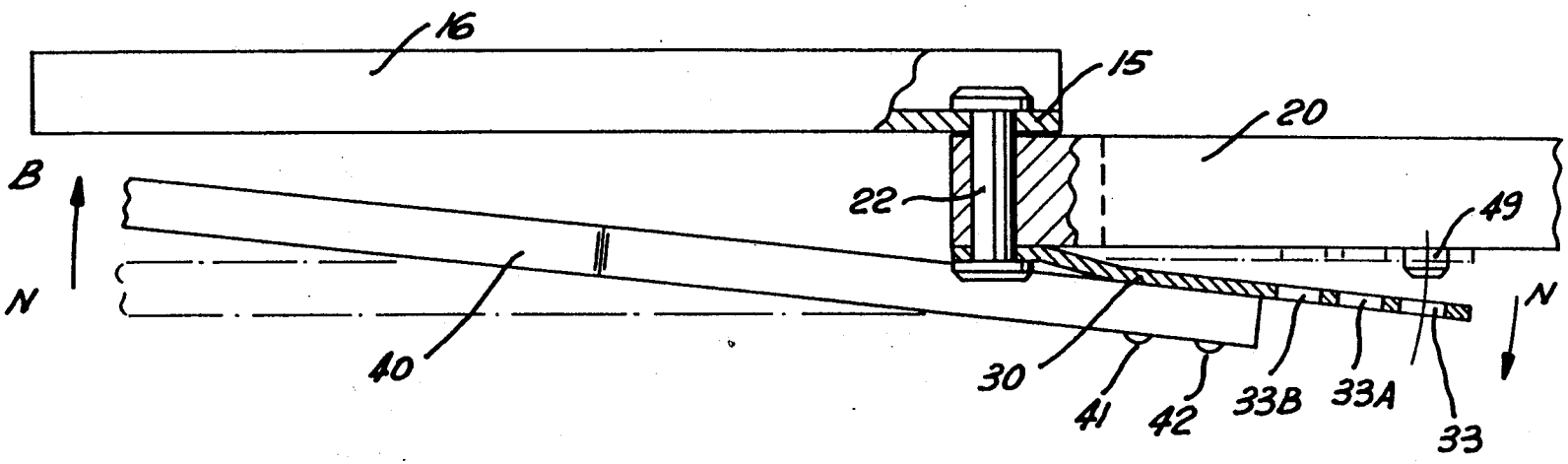
FIG. 12 shows schematically the embodiment of FIG. 11 when viewed in plan.
Figure 13:
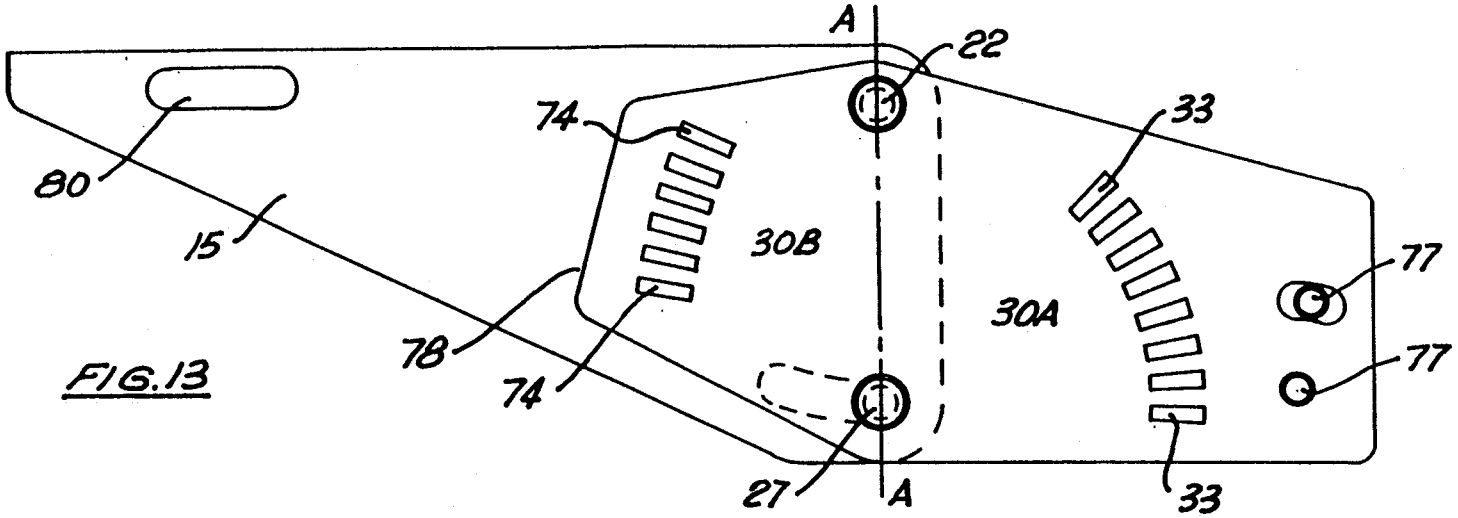
FIG. 13 shows schematically a portion of a fourth embodiment of the invention viewed in elevation.
Figure 14:
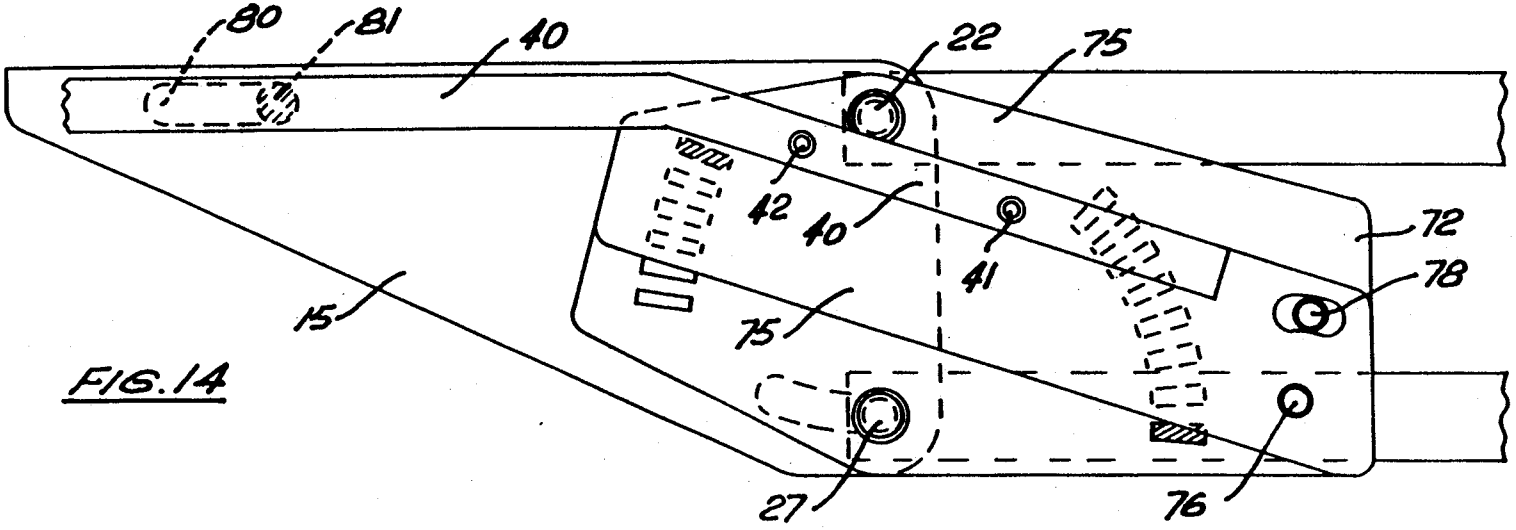
FIG. 14 shows schematically an assembly of the portion of FIG. 13 with additional parts.

With reference to FIGS. 13, 14, 15, there is shown a fourth embodiment of the invention in which parts having a function corresponding to parts of FIGS. 11, 12 are indicated by corresponding numerals. The embodiment of FIGS. 13 to 15 has a curvilinear slot 70 adapted to cooperate with pin 27 to permit tilt of bracket 15 about pivot 22. The embodiment of FIG. 13 also differs from that of FIG. 11, 12 in that spring steel plate 30 in its relaxed state extends to both sides of fulcrum line A—A, in a plane parallel the reference plane. Spring plate 30 has a portion 30A extending to free edge 72. Portion 30A has a plurality of elongate slots 33 arranged on lines extending radially from pivot pin 27. Spring plate 30 also has a portion 30B extending to free edge 73 on the opposite side of line A—A from edge 52.

Spring plate 30B is provided with slots 74.

A spring arm 75 is mounted to spring plate 30A adjacent edge 72 by means of rivets 76 extending through apertures 77. Spring arm 75 extends to a free end 78 adjacent edge 73 of plate 30B.

Cranked lever 40 is mounted to spring arm 75 by means of rivets 41 and 42 spaced astride fulcrum line A—A.

Figure 15A:
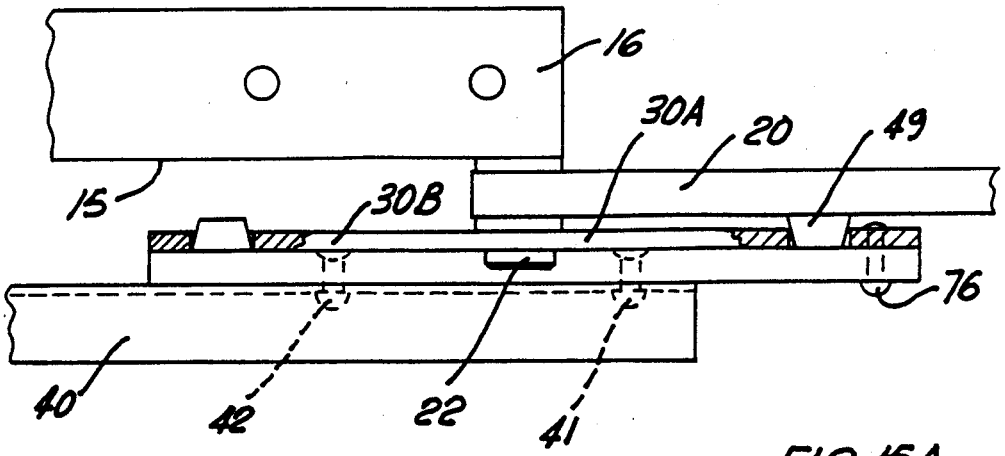
FIGS. 15 A, B, C show schematically the embodiment of FIG. 14 viewed in plan in various modes of operation.

As shown in FIG. 15A, when spring plate 30A and spring arm 75 are relaxed, pin 49 extending laterally from bar 25 engages a slot 33 of spring plate 30A. A detent or pin 79 adjacent free end 78 of spring arm 75 extends laterally to engage a slot 74, of spring plate 30B penetrating from the side opposite to that from which pin 49 penetrates spring plate 30A.

Figure 15B:
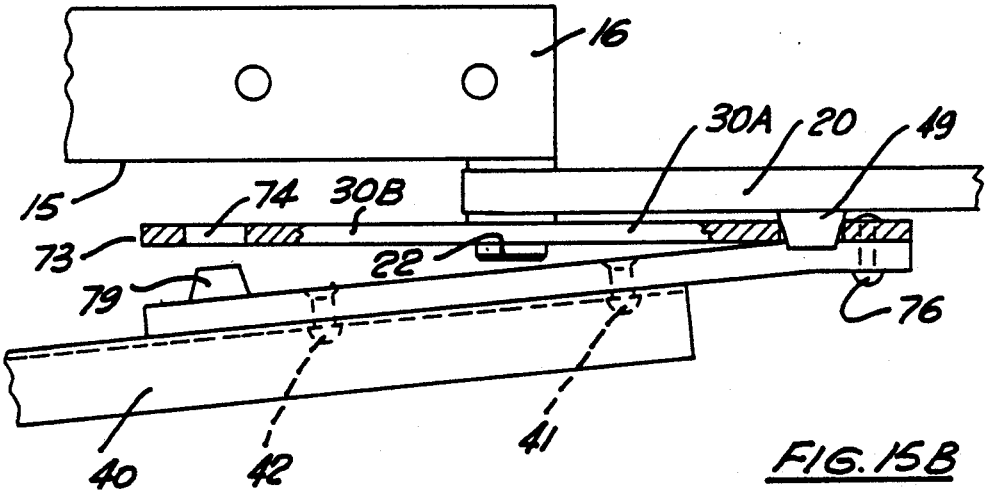

As shown in FIG. 15B when lever 40 is moved from neutral position N in the direction indicated by arrow D, spring arm 75 resiliently deforms; detent 79 associated with spring arm 75 is laterally withdrawn from slot 74 of spring plate 30B and support bracket 15 is thus free to tilt by pivotal movement about pivot 22.

However, engagement of pin 49 with spring plate 30A maintains support bracket 15 at a predetermined altitude.

Figure 15C:
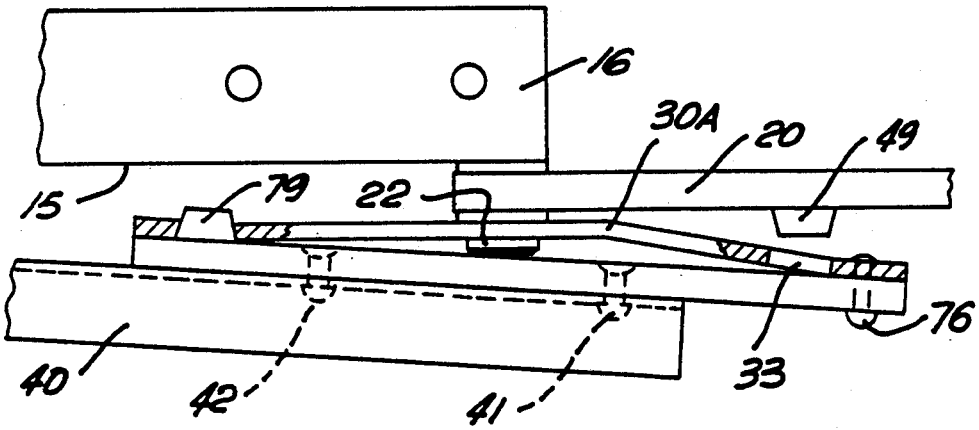

With reference to FIG. 15C, if lever 40 is moved from neutral position N in the direction indicated by arrow C, then detent 79 remains engaged with an aperture 74 of spring plate 30B.

Spring plate 30B is deformed so as to disengage pin 49 from aperture 33 of spring plate 30A. In that configuration altitude adjustment may be made by moving lever 40 upwardly or downwardly. However, engagement of pin 79 with an aperture 74 of spring plate 30B maintains support bracket 15 at a predetermined angle of tilt.

The embodiment of FIGS. 13 to 15 thus allows single handed raising or lowering of the keyboard at a predetermined angle of tilt following a small movement of lever 40 in direction C. The embodiment also allows a single handed tilting of the keyboard at a predetermined altitude following a slight movement of lever 40 in direction D. The lever is resiliently biased towards neutral position N in which the keyboard is locked against movement in either altitude or attitude. The construction of the adjustment mechanism is robust, the spring plate being of about 1.2 mm to 2.0 mm in thickness. Preferably, bracket 15 is provided with a slot 80 and lever 40 has a pin 81 adjustable eccentrically about a pin axis to maintain the lever handle in a constant relationship to bracket 15 and to facilitate positive action of the lever when adjusting tilt or height while allowing lateral movement of the lever arm.

Preferably spring plate 30 is of greater resiliency than spring arm 75. If preferred, spring plates 30A and 30B may be separate plates rather than parts of one plate as illustrated. The parts may be connected one to another by means different from those described.

Desirably, spring arm 75 is provided with an angle of bend in its relaxed state whereby formation 79 is urged towards interengagement.

The terms "vertical" and "horizontal" are not used in an absolute sense in this specification and merely indicate a direction close to the upright or a direction close to the horizontal direction respectively.

As will be apparent to those skilled in the art from the teaching hereof, the apparatus herein described is simple and relatively inexpensive to manufacture, provides positive engagement or disengagement on locking, is convenient for use by an operator in a seated or "user" position and is unobtrusive in appearance.

The apparatus of FIGS. 13 to 15 may also be used for adjustment, for example, of a hospital bed tray by a person in a prone position using one hand.

The invention extends to include mechanical equivalents of the principle herein disclosed and features of one embodiment may be combined with those of another within the scope of the invention.

I claim:

1. A keyboard support apparatus of the kind having a mounting bracket, a support member, at least one linkage bar pivotally connected to the mounting bracket and to the support member whereby the support member and bar are adapted for movement in a vertical reference plane between a raised or lowered position relative to the mounting bracket, and locking means for immobilizing the apparatus against said movement; the locking means comprising first means defining a first formation associated with the support member; second means defining a second formation associated with the bar; said formations being inter-engageable to prevent movement of the bar relative to the support member, lever means acting to disengage said formations by lateral movement of the first means relative to the second means, and resilient means biasing said formations into inter-engagement.

2. Apparatus according to claim 1 wherein the first means comprises a spring plate mounted to the support member and extending in a vertical plane parallel to the reference plane, said spring plate defining a plurality of aperture formations.

3. Apparatus according to claim 2 wherein the apertures are slot-shaped.

4. Apparatus according to claim 2 having a pin formation of the bar engageable with an aperture of the spring plate.

5. Apparatus according to claim 3 wherein the second formations are elongate protrusions.

6. Apparatus according to claim 2 wherein a lever handle is mounted to the spring plate.

7. Apparatus according to claim 1 wherein the support member is adapted to tilt about a horizontal pivotal axis.

8. Apparatus according to claim 7 wherein the first means comprise a spring plate mounted to the support member and having a plurality of apertures disposed in two or more concentric arcs.

9. Apparatus according to claim 1 wherein the support member is mounted for adjustment of tilt about a horizontal axis, further comprising third means defining a third formation associated with the support member and a fourth formation associated with the bar, said third and fourth formations being inter-engageable to prevent tilt movement of the support member relative to the bar.

10. Apparatus according to claim 9 wherein the lever can selectively disengage either the first from the second formations or the third from the fourth formations.

11. Apparatus according to claim 9 wherein the first means comprises a first spring plate mounted to the support member and extending in a vertical plane parallel to the reference plane, said first plate defining a plurality of first aperture formations.

12. Apparatus according to claim 11 wherein the third means comprises a second spring plate defining a plurality of third aperture formations.

13. Apparatus according to claim 12 wherein a spring arm mounted to the first spring plate carries a fourth formulation selectively inter-engageable with one of the third aperture formations.

14. A keyboard support apparatus of the kind having a mounting bracket, a support member, at least one linkage bar pivotally connected to the mounting bracket and to the support member whereby the support member and bar are adapted for movement in a vertical reference plane between a raised or lowered position relative to the mounting bracket, and for tilting movement about a horizontal axis and locking means for immobilizing the apparatus against said movements; the locking means permitting selective release either of the tilting movement or of the vertical movement.

15. A keyboard support apparatus of the kind having a mounting bracket, a support member, at least one linkage bar pivotally connected to the mounting bracket and to the support member whereby the support member and bar are adapted for height adjustment between a raised and lowered position relative to the mounting bracket, the support member being pivotally connected to the bar whereby the support is adapted for tilt adjustment about a horizontal axis, and locking means for immobilizing the apparatus against said height adjustment and tilt adjustment, the locking means permitting one-handed selective release of one of the tilt adjustment or of the height adjustment, while preventing the other of said adjustments.

16. Apparatus according to claim 15 comprising a first means including a first formation biased towards inter-engagement with a second formation associated with the bar to prevent said height adjustment, third means including a second formation biased towards inter-engagement with a fourth formation associated with the support member to prevent said tilt adjustment, and selection means operable single-handedly to disengage either the first formation from the second formation or the third formation from the fourth formation.

17. Apparatus according to claim 15 comprising:

a spring plate pivotally connected to the bar at a first mounting;

a lever mounted to the spring plate at a second mounting;

the first formation being associated intermediate said mountings with the spring plates and thereby biased towards engagement with the second formation, the plate being deformable about the first mounting by operation of the lever to disengage the first formation from the second.

18. Apparatus according to claim 17 wherein the spring plate has a portion forming an extension of the bar and having a third formation which is inter-engageable with a formation of the lever, the third formation being disengageable from the fourth by operation of the lever to deform the plate adjacent the second mounting.

* * * * *